US006622348B1

(12) United States Patent
Badrenas Buscart

(10) Patent No.: US 6,622,348 B1
(45) Date of Patent: Sep. 23, 2003

(54) CONNECTION TERMINALS FOR STRAPS

(75) Inventor: Jordi Badrenas Buscart, Barcelona (ES)

(73) Assignee: ITW Espana, S.A., Barcelona (ES)

( * ) Notice: Subject to any disclaimer, the term of this patent is extended or adjusted under 35 U.S.C. 154(b) by 0 days.

(21) Appl. No.: 10/049,440

(22) PCT Filed: Dec. 31, 1999

(86) PCT No.: PCT/ES99/00415

§ 371 (c)(1),
(2), (4) Date: May 31, 2002

(87) PCT Pub. No.: WO01/12001

PCT Pub. Date: Feb. 22, 2001

(30) Foreign Application Priority Data

Aug. 12, 1999 (ES) ..... 9900186

(51) Int. Cl.[7] ..... A44B 11/06

(52) U.S. Cl. ..... 24/169; 24/265 EC; 24/265 BC; 24/200

(58) Field of Search ..... 24/198, 200, 169, 24/6 BE, 71.1, 265 BC, 265 EC, 265 AL, 265 H

(56) References Cited

U.S. PATENT DOCUMENTS

| | | | | | |
|---|---|---|---|---|---|
| 3,285,659 | A | * | 11/1966 | Robbins | 24/198 X |
| 3,735,455 | A | | 5/1973 | Hammer | |
| 4,281,440 | A | | 8/1981 | Britz | |
| 4,296,531 | A | | 10/1981 | Bengtssow | |
| 4,387,490 | A | * | 6/1983 | Blackburn et al. | 24/200 |
| 4,400,855 | A | * | 8/1983 | Stuart | 24/200 |
| 4,484,379 | A | * | 11/1984 | Appelt et al. | 24/197 |
| 4,843,689 | A | | 7/1989 | Fildam | |
| 5,176,106 | A | * | 1/1993 | Casto et al. | 24/169 X |
| 5,608,918 | A | * | 3/1997 | Salvaggio | 2/421 |
| 5,706,560 | A | * | 1/1998 | Anscher et al. | 24/543 |

FOREIGN PATENT DOCUMENTS

| | | |
|---|---|---|
| FR | 2 226 942 | 11/1974 |
| FR | 2 665 226 | 1/1992 |

* cited by examiner

*Primary Examiner*—Robert J. Sandy
(74) *Attorney, Agent, or Firm*—Lowe Hauptman Gilman & Berner, LLP

(57) ABSTRACT

Applicable to tapes like those employed in backpacks, handbags, cyclists' helmets and similar goods, it is constituted by means of a piece (1) injected in plastic in which are defined two bodies (2-3) connected by means of a hinge (4), these bodies coming with respective slots (8-8') for the passage of the tape to which the termination has to be coupled, and one of said bodies (3) having side claws (6) which, through elastic, deformation of said body, can couple into complementary recesses (7) in the other body (2), in order to stabilise the clamp formed by the termination in the closed position upon the tape.

25 Claims, 2 Drawing Sheets

A-B

C-D

CONNECTION TERMINALS FOR STRAPS

OBJECT OF THE INVENTION

The present invention relates to a termination of those employed for finishing the free extremity of a tape, generally manufactured on a basis of nylon or similar, whereby a substantial reduction is achieved in costs for the fastening of the termination to the tape, as well as a possibility of regulation in position for said termination.

The invention is applicable within the sphere of backpacks, handbags, cyclists' helmets, etc., in which tapes of the type mentioned above are used, as harnesses, means of fastening, means of closing, etc.

BACKGROUND OF THE INVENTION

The tapes for the applications mentioned above or others similar, come in a fabric structure, participating generally as base material in the constitution thereof nylon thread or other synthetic similar products, with or without the admixture of natural products, and as common denominator all of them require their free end to be finished in a termination which, as well as finishing the tape decoratively, impedes the fraying thereof and especially permits its coupling with other parts of the object on which it is fitted.

One of the commonly adopted solutions for implementing this termination, generally of plastic material, consists in providing said termination with a housing for the extremity of the tape, into which the latter is introduced and is subsequently fixed with the collaboration of a stitching process, which has to be sufficiently robust to endow the termination with a certain resistance to pulling. This solution has a fundamental problem in the cost of the stitching operation which has a considerable impact on the cost of the end product. Even in some cases, such as life jackets and in infants' chairs, it is necessary to position the entire finished product on the stitching table, since the tape stitching process takes place at the end of the production cycle. This, doubtless, augments even more the manufacturing cost.

Another solution consists in fastening the termination to the tape by means of the employment of rivets or similar, in which case the plastic piece is usually in the material form of two parts which adapt to the respective faces of the tape and which are finally fastened with one or more rivets, which also makes necessary the employment of machines for implanting the rivets in question, both in the case mentioned and in a further solution existing in this respect consisting in folding back the end of the tape on itself configuring a hem which is fixed with the rivets mentioned.

Another problem inherent to any of the solutions indicated above, lies in the fact that the termination is rigidly fixed to the end of the tape, there being no possibility of adjusting the effective length of said tape, in such a manner that in order to achieve the adjustment mentioned it is necessary to provide the tape, together with the termination mentioned, with another auxiliary mechanism which permits such adjustment.

DESCRIPTION OF THE INVENTION

The termination which is proposed by the invention overcomes in a fully satisfactory manner the problems outlined above, in the different aspects mentioned, constituting a structurally simple solution, very easy to assemble, which acts simultaneously as a means of adjusting the effective length of the tape, adjustment which can not only be implemented in manufacture but also throughout the period during which the tape is employed by the user thereof.

To this end and in more specific form, the termination which is proposed is implemented by means of a plastic piece which configures a type of clamp, of width in accordance with that of the tape for which it is intended, clamp in which participate two bodies, noticeably flat, connected to each other to form a unit by means of an intervening articulating hinge, obtained on a basis of weakened sectors in the region of union between the two bodies, each one of which configures a type of shallow cup, each of these incorporating also, in the bottom of each, a slot through which the tape passes, parallel and relatively close to said hinge, the slots of one and the other body being noticeably different in width and being provided with toothed edges, the teeth of which are directed towards the inside of the clamp, in such a manner that the teeth of one body are slightly offset with respect to those of the other in order to define in the tape a slight inflection in its path which enhances the gripping effect.

As a complement to the structure described one of the two bodies incorporates on its side edges respective claws, saw-tooth in outline, intended for insertion in internal and complementary recesses of the other body, when the coupling between the two takes place, with the interposition of the tape, said claws acting as a means of locking for the clamp in the closed position, which permit a straightforward assembly thereof on the tape and which guarantee perfect stability of the termination with respect thereto.

Moreover, each of the bodies mentioned presents, in correspondence with its edge opposite the hinge, an internal rim, in such a manner that these rims exercise in turn a pinching effect on the tape.

In accordance with this construction the end of the tape rests against the inside face of one of the bodies, emerges to the outside through the corresponding slot, passes behind the hinge towards the slot of the second body, penetrates inside said second body and is perfectly fastened when the clamp is closed especially through the effect of the complementary teeth, whilst by performing the closure of said clamp by means of a male-female coupling which permits the subsequent opening thereof, the user may at any time adjust at will the effective length of the tape, up to the point where the termination may even not be closed in manufacture leaving it at the option of the user to position it directly at the location on the tape which he prefers and in this eventuality cut off the segment of tape in excess.

DESCRIPTION OF THE DRAWINGS

In order to complete the description being made and for the purpose of assisting in a better understanding of the characteristics of the invention, in accordance with a preferred example of embodiment thereof, and forming an integral part of said description, a set of drawings is attached in which by way of illustration and not restrictively, the following has been shown.

PREFERRED EMBODIMENT OF THE INVENTION

Figure 1:
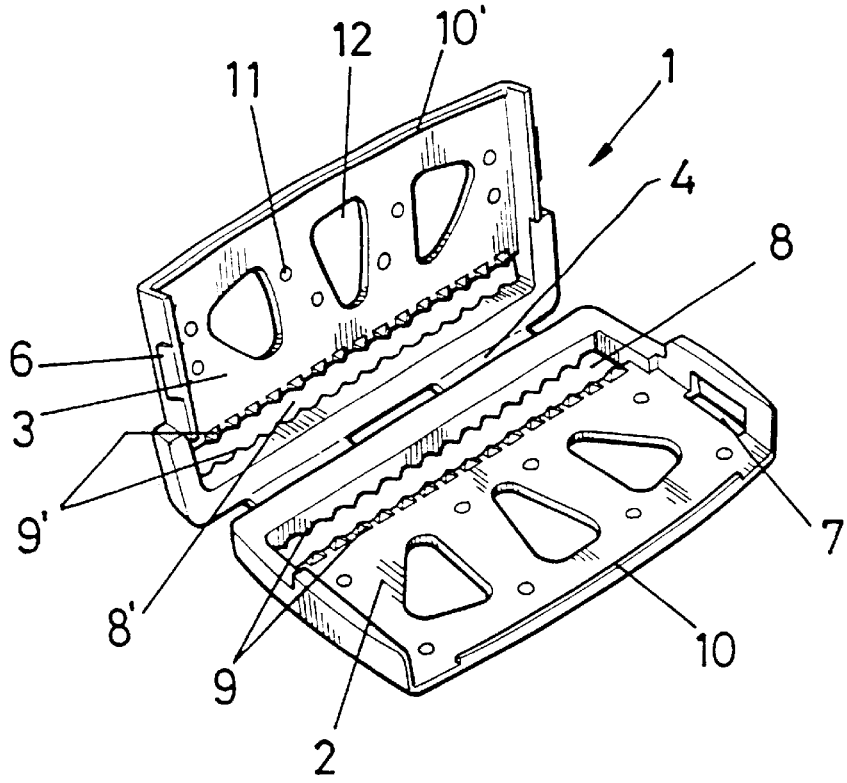
FIG. 1. Shown is a view in perspective of a tape finishing termination for implementation in accordance with the object of the present invention, which is shown in the open position.
Figure 2:
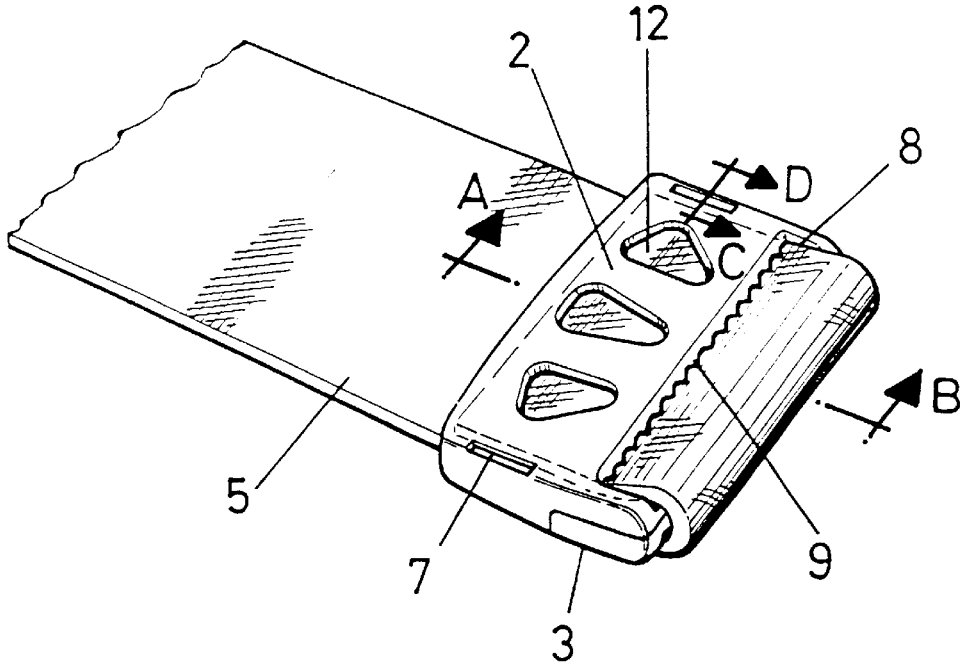
FIG. 2. Shown, also in a perspective view, is the termination of the previous figure duly coupled to the end of a tape.

In the light of these figures, it can be seen how the finishing termination for tapes which is proposed by the invention is structured by means of a single piece (1), preferentially injected in plastic material, in which piece are defined two bodies (2) and (3), noticeably flat, which are shaped in the form of respective cups joined to each other by means of an articulating hinge (4) which converts them into a kind of clamp capable of adopting the open position shown in FIG. 1 or the closed position shown in FIG. 2, which position being established in a stable fashion, after the insertion of the tape (5), thanks to the presence in one of the bodies (3), specifically on its side edges, prepared for fitting inside the body (2), of a pair of side claws (6) , saw-tooth in shape, which after elastic deformation fit into recesses (7) implemented in the other body (2), which permits the closure of the clamp to be performed by simply pressing on one body (3) with respect to the other (2).

The body (2) comes with a wide slot (8), parallel and relatively close to the edge thereof in which the hinge (4) is mounted, slot (8) delimited by each toothed edge (9), with its teeth pointing towards the inside of the cup, whilst on the body (3) is established in turn another slot (8'), noticeably narrower that the previous one, facing the latter in the closed position and equally delimited by teeth (9') similar to those previously mentioned.

Figure 3:
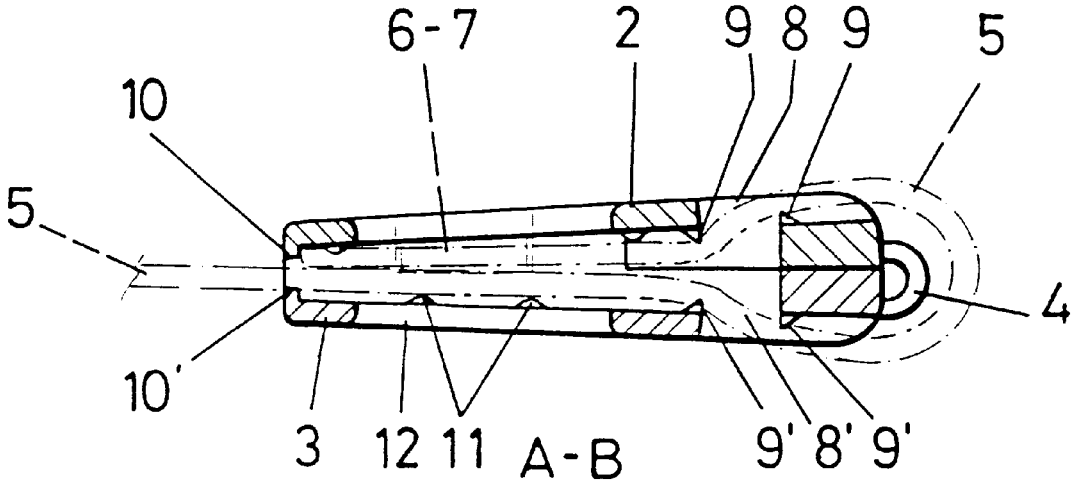
FIG. 3. Shown is a detail in side elevation and in cross section of the assembly illustrated in the previous figure, according to the cut A-B of said figure.
Figure 4:
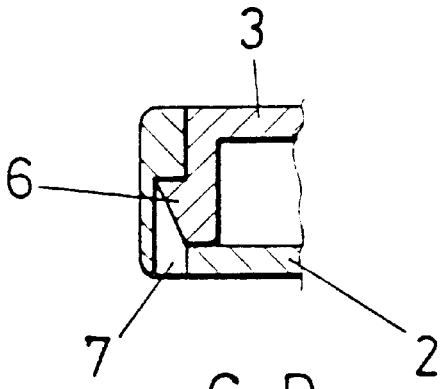
FIG. 4. Shown, finally, is a detail in cross section of the assembly illustrated in FIG. 2, at the level of one of the interlocking points between the two bodies of the clamp, in accordance with the cut C-D of said figure.

In accordance with this construction and starting from the open position shown in FIG. 1, the tape (5) is able to pass easily through the slot (8), from the inside of the body (2), coming out on the outside, passing over the hinge (4) and being housed inside the other body (3), through the slot (8') of the latter, and from this situation the clamp defined by the two bodies is capable of being closed and of maintaining said closure stable, thanks to the male-female coupling which can be seen especially in the detail of FIG. 4, closed position in which the teeth (9-9') bite into the end, folded-back segment of the tape (5), as is also shown in FIG. 3, preventing the occurrence of longitudinal displacement of the tape with respect to the termination in the event of pulling forces that may be applied to these elements.

It only remains to point out finally that both bodies (2-3) each incorporate on their free edge opposite the hinge (4) rims (10-10'), which in the closed position operate facing each other to determine a supplementary clamping zone for the tape (5), as may also be observed in the cross section of FIG. 3, there being also on the inside face of the two bodies (2) and (3) small conical protuberances (11) which collaborate likewise in said fastening, and said bodies also being provided with broad hollows (12) which, as well as having a favourable impact on the appearance of the termination, lighten the material thereof in those areas where it proves non-operational.

What is claimed is:

1. A clamp for a tape, said clamp comprising two casings and a hinge pivotally connecting said casings, wherein said casings, when said clamp is in a closed position, together define an internal space of said clamp for accommodating a section of the tape;

each of said casings has a slot for introduction or withdrawal of the section of the tape into or from said internal space of said clamp; and each of said slots is provided along an edge thereof with a plurality of teeth directed into said internal space of said clamp when said clamp is in the closed position.

2. The clamp of claim 1, wherein said casings and said hinge are integrated into a single piece.

3. The clamp of claim 1, wherein one of said slots is wider than the other.

4. The clamp of claim 1, wherein the teeth of one of said slots are offset from the teeth of the other of said slots to define a curved passage for the section of the tape.

5. The clamp of claim 1, wherein said casings have interlocking elements that engage each other, when said clamp is in the closed position, to releasably lock said casings together.

6. The clamp of claim 1, wherein one of said casings has a recess and the other of said casings has a claw adapted to snap-fit into said recess when said clamp is in the closed position for releasably locking said casings together.

7. The clamp of claim 1, wherein each of said casings includes a plurality of projections directed into said internal space of said clamp when said clamp is in the closed position; and a rim on a side opposite said hinge, said rims and said projections being adapted to cooperate in clamping the section of the tape between said casings.

8. The clamp of claim 1, wherein at least one of said slots is further provided, along another edge of said at least one slot, with a series of teeth that are directed away from said internal space of said clamp when said clamp is in the closed position.

9. The clamp of claim 8, wherein the edges of said at least one slot, which are provided with the teeth, are opposite longitudinal edges of said slot.

10. The clamp of claim 9, wherein the teeth that are directed away from said internal space of said clamp are arranged along the one of said opposite longitudinal edges which is closer to said hinge than the other opposite longitudinal edge.

11. The clamp of claim 1, wherein each of said casings includes a bottom wall and side walls extending circumferentially of said bottom wall, the slot of said casing being formed in the bottom wall and extending parallel to one of said side walls which is connected to said hinge.

12. The clamp of claim 11, wherein at least one of said casings further includes, besides said slot, an aperture extending through said bottom wall.

13. A clamp for a tape, said clamp comprising two casings and a hinge pivotally connecting said casings, wherein said casings, when said clamp is in a closed position, together define a housing for accommodating a section of the tape; and each of said casings has a slot for introduction or withdrawal of the section of the tape into or from said housing, said slots of said casings communicating an interior of said housing with an exterior of said housing.

14. The clamp of claim 13, wherein each of said casings includes a plurality of conical projections directed into the interior of said housing; and each of said casings further includes a rim on a side opposite said hinge, said rims and said conical projections are adapted to cooperate in clamping the section of the tape between said casings.

15. The clamp of claim 14, wherein said casings and said hinge are integrated into a single piece.

16. The clamp of claim 14, wherein one of said slots is wider than the other; and the teeth of one of said slots are offset from the teeth of the other.

17. The clamp of claim 14, wherein said casings have interlocking elements that engage each other, when said clamp is in the closed position, to releasably lock said casings together.

18. The clamp of claim 14, wherein each of said casings includes a bottom wall and side walls extending circumferentially of said bottom wall, said conical projections of said casing projecting from said bottom wall, and said slot of said casing being formed in said bottom wall between said conical projections and said hinge.

19. The clamp of claim 13, wherein each of said casings includes a bottom wall and side walls extending circumferentially of said bottom wall; and when said clamp is in the closed position, said bottom walls of said casings taper away from said hinge.

20. In combination, a clamp comprising two casings and a hinge pivotally connecting said casings, said casings being locked together in a closed position of said clamp to define a housing; and a strap partially received within said housing and clamped between said casings;

wherein each of said casings has a slot through which the strap extends from an interior of said housing to an exterior of said housing; and said housing further has an opening other than said slots of said casings, the strap extending from the interior of said housing through said opening to the exterior of said housing.

21. The combination of claim 20, wherein said strap includes a first section accommodated within said housing;

a second section contiguous to said first section, said second section extending from the interior of said housing to the exterior thereof via one of said slots, bending around said hinge, and passing back into the interior of said housing via the other of said slots; and a third section contiguous to said second section, said third section escaping said housing through said opening.

22. The combination of claim 20 wherein an end of said strap is completely received within said housing.

23. The combination of claim 20, wherein said opening is defined by spaced side walls of said casings.

24. The combination of claim 20, wherein said casings include teeth that are directed to the interior of said housing, said strap being clamped between said teeth.

25. The combination of claim 20, wherein said casings include teeth that are directed to the exterior of said housing and in physical contact with said strap.

* * * * *

UNITED STATES PATENT AND TRADEMARK OFFICE

CERTIFICATE OF CORRECTION

PATENT NO. : 6,622,348 B1
DATED : September 23, 2003
INVENTOR(S) : Badrenas Buscart It is certified that error appears in the above-identified patent and that said Letters Patent is hereby corrected as shown below:

Title page,
Item [54], Title, should read -- TAPE FINISHING TERMINATION --
Item [30], Foreign Application Priority Data, "9900186" should read -- 9901865 --.

Signed and Sealed this

Seventh Day of September, 2004

JON W. DUDAS
*Director of the United States Patent and Trademark Office*